United States Patent [19]

Lamphier et al.

[11] 4,322,179

[45] Mar. 30, 1982

[54] OPEN TOP DRAIN

[75] Inventors: Larry N. Lamphier, Mechanicsburg, Pa.; Walter A. Meyers, Bel Air, Md.

[73] Assignee: Bethlehem Steel Corporation, Bethlehem, Pa.

[21] Appl. No.: 144,118

[22] Filed: Apr. 28, 1980

[51] Int. Cl.[3] ..... E01C 11/22; E02B 11/00

[52] U.S. Cl. ..... 405/36; 405/43; 405/124; 404/4

[58] Field of Search ..... 405/36, 43, 49, 124, 405/125, 126, 146, 155; 425/59; 404/2, 4; 264/31; 52/100

[56] References Cited

U.S. PATENT DOCUMENTS

| | | | |
|---|---|---|---|
| 59,804 | 11/1886 | Whitehead | 404/4 |
| 1,048,153 | 12/1912 | Haight | 405/126 |
| 1,362,952 | 12/1920 | McQueary | 404/2 |
| 3,319,384 | 5/1967 | Berg | 52/100 |
| 3,714,786 | 2/1973 | Evans et al. | 405/49 |
| 3,753,352 | 8/1973 | McNally | 405/43 |
| 3,815,213 | 6/1974 | Evans et al. | 29/446 |
| 3,882,743 | 5/1975 | Evans et al. | 83/156 |
| 4,163,619 | 8/1979 | Fales | 405/49 |

*Primary Examiner*—Price C. Faw, Jr.
*Assistant Examiner*—Nancy J. Pistel
*Attorney, Agent, or Firm*—Joseph J. O'Keefe; Michael J. Delaney; John I. Iverson

[57] ABSTRACT

A corrugated metal open top pipe drain for the collection and removal of surface water from paved areas, such as highways, parking lots, airports and the like.

4 Claims, 5 Drawing Figures

OPEN TOP DRAIN

BACKGROUND OF THE INVENTION

This invention relates to drainage culverts or pipes and relates particularly to a corrugated metal open top drain pipe used for the collection and removal of surface water from paved areas, such as highways, parking lots, airports and the like.

Surface water is normally removed from paved areas by constructing the pavement with an appropriate pitch and installing a network of curbs, gutters or other barriers and spaced catch basins. In recent years, highway engineers have become concerned with the adequacy of such conventional surface water drainage arrangements since it has been discovered that high speed vehicle handling can be seriously impaired if the vehicle's tires are caused to hydroplane due to a water film on the surface of the pavement. A number of serious accidents have occurred as a result of the highway drainage systems' inability to quickly and adequately remove surface water during a heavy rain storm. In addition, some of the drainage structures, such as curbs and catch basins, are themselves hazardous to any vehicle coming in contact with them.

On large paved areas, such as parking lots or airport aprons, it is impractical to use curbs, gutters or sufficient catch basins to service the large volumes of surface water and therefore ponding of the surface water often occurs, which in cold climates can result in an ice hazard.

Open top culverts have been used in the past and are the subject of U.S. Pat. Nos. 1,362,952 and 1,444,198 to McQueary and U.S. Pat. No. 3,714,786 to Evans, et al. Such previous open top culverts have either had structural deficiencies that prevented them from performing well over an extended period of time or were expensive to fabricate and install.

SUMMARY OF THE INVENTION

It is an object of this invention to provide an open top drain which will quickly and adequately remove large quantities of surface water from a paved area.

It is a further object of this invention to provide an open top drain which when installed does not present a hazard to vehicles.

It is another object of this invention to provide an open top drain which is economical to manufacture and install and will perform satisfactorily over an extended period of time.

It is a still further object of this invention to provide an open top drain which is versatile and easily adaptable to a variety of locations where surface water drainage is required.

It has been discovered that the foregoing objectives can be attained by providing a corrugated cylindrical culvert having a plurality of longitudinal spaced apart openings for the entry of water on the upper side of the culvert.

DESCRIPTION OF THE PREFERRED EMBODIMENT

Figure 1:
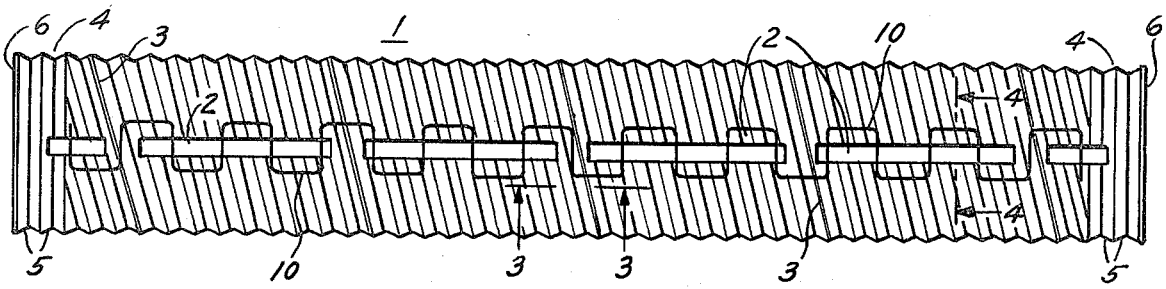
FIG. 1 is a top view of a length of one embodiment of the open top drain of this invention.
Figure 2:
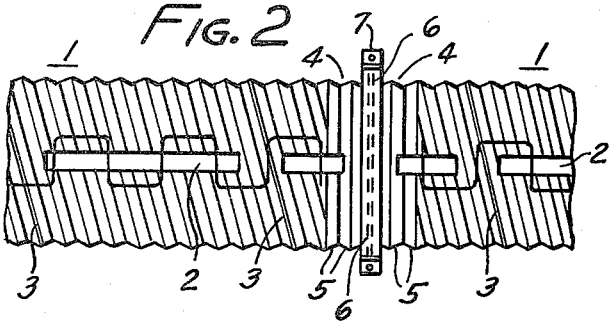
FIG. 2 is a partial top view of two lengths of the open top drain of this invention whose abutting ends are joined by a coupling band.

Referring to FIGS. 1 and 2, the preferred embodiment of this invention comprises a corrugated helical lock seam pipe 1 having a plurality of longitudinally spaced openings 2 formed in the upper side of the pipe 1.

Corrugated helical pipes or culverts are well known and are made from a continuous strip of metal, such as steel, which is first corrugated and then helically bent to form a cylinder with the opposing edges of the steel strip joined together by a lock seam 3 or by welding. While we prefer to use a corrugated helical lock seam pipe 1 for our invention, annularly corrugated or even smooth walled cylindrical pipe could be used for our invention also, if desired.

As best illustrated in FIG. 2, we prefer to reform the ends 4 of the pipe 1 to form several annular corrugations 5 and a flange 6, as described in U.S. Pat. No. 4,079,614 to Hall, to enable the pipes 1 to be connected end to end with a channel shaped coupling ring 7.

If desired, it would not be necessary to reform the ends of the pipe 1 as described above in which case any of the well known conventional annular connecting bands which engage the corrugations could be used to connect the ends 4 of the pipes 1 together.

The openings 2 formed in the upper side of the pipe 1 of this invention extend along the longitudinal axis of pipe 1 at regular repeating intervals and are preferably a plurality of longitudinally spaced, longitudinally elongated rectangular slots, as best shown in FIGS. 1 and 2. The ends of the slot-like openings 2 terminate short of lock seam 3 or weld.

As contrasted with previous open top drains, the longitudinal openings 2 are not continuous but are disposed at regular repeating intervals. Sufficient metal remains between the openings 2 to preserve the structural integrity of the pipe 1.

Figure 3:
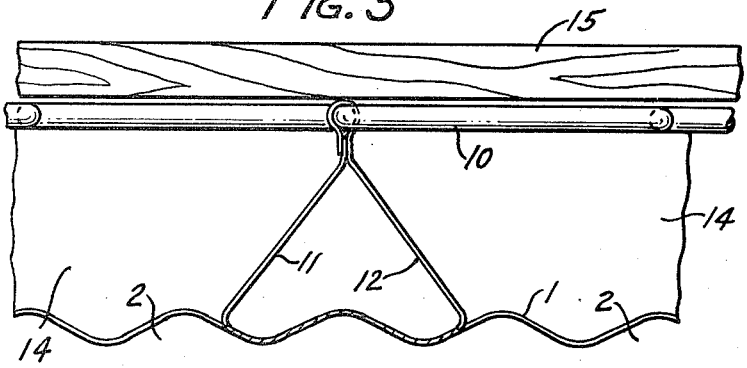
FIG. 3 is a sectional view taken along lines 3—3 of FIG. 1.
Figure 5:
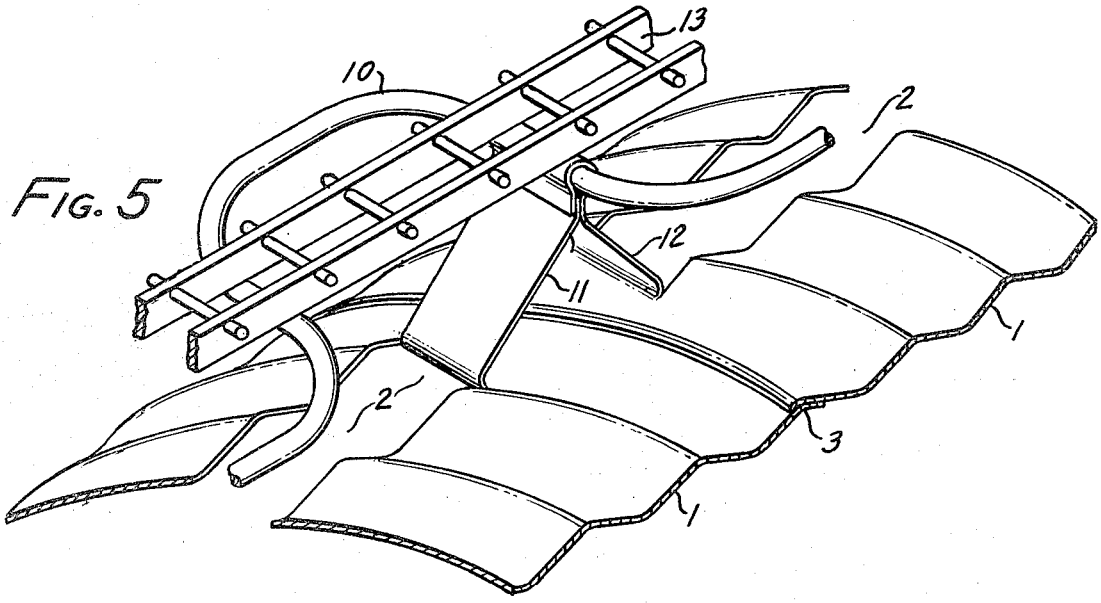
FIG. 5 is an isometric view of the open top drain of this invention.

As best illustrated in FIGS. 3 and 5, a continuous serpentine shaped crossbar 10 is held in a horizontal plane spaced above and extending over the openings 2 by support straps 11 and 12 formed by bending upwardly the metal strips cut from the pipe 1 when the openings 2 are formed. One of support straps 12 is made slightly longer than the adjacent support strap 11 and is bent around crossbar 10 as shown in FIG. 5 and then attached to the end of support strap 11 by a fastener, welding or a friction crimp to secure and hold crossbar 10 in a predetermined position.

As contrasted with previous open top drain designs, this invention makes effective use of the metal that would normally be discarded in forming the opening 2 and eliminates complicated fabricated gratings and the like. The serpentine crossbar 10 can alone serve as a grating over the openings 2 or can be supplemented as desired by a fabricated ladder-like grating 13 as illustrated in FIG. 5 which is welded or otherwise secured to crossbar 10.

Figure 4:
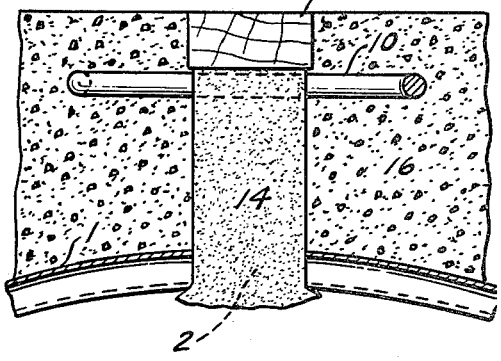
FIG. 4 is a partial sectional view of the open top drain of this invention installed in a pavement.

As best shown in FIG. 4, the serpentine crossbar 10 becomes imbedded in the concrete pavement 16 during its pouring and serves also to anchor pipe 1 to the pavement and prevent any rotational or other movement of pipe 1 when in place.

As shown in FIGS. 3 and 4, an expendable lightweight plastic foam form member 14 is cast in the shop to temporarily cover the openings 2 until the pipe 1 is installed in the field and to act as a form to shape the slot in the concrete 16. The plastic form 14 extends continuously from one end of pipe 1 to the other just inside the openings 2 as shown in FIG. 4 to a predetermined height above crossbar 10 and has a width approximately the width of the slotted openings 2.

The plastic form 14 is preferably cast around the support strips 11 and 12 and crossbar 10 which provide reinforcement to the plastic form 14 during transport and installation of pipe 1.

The plastic form 14 prevents leakage of the wet concrete into the pipe 1 through openings 2. When the concrete pavement 16 has cured, the expendable plastic form 14 is removed, usually by breaking it into pieces, and the drain is ready for use.

If desired, a separate wooden or plastic cap 15 may be placed on top of the plastic form 14 during installation to provide a rectangular opening in the concrete immediately above crossbar 10 for receiving the ladder-like grating 13 as shown in FIG. 5. Proper spacing of the grating 13 relative to the openings 2 in pipe 1 is assured by the position of crossbar 10.

In a specific example of this invention, the pipe 1 was a spirally corrugated galvanized steel pipe having a wall thickness of 0.064 inch (0.162 centimeter). Openings 2 were cut approximately 2 inches (5.08 centimeters) wide and 25 inches (63.5 centimeters) long. Crossbar 10 was a ½ inch, (12.7 centimeters), deformed reinforcing bar bent uniformly every 6 inches (15.24 centimeters) to extend 2 inches (5.08 centimeters) into the concrete on either side of opening 2. Crossbar 10 was spaced approximately 3 inches (7.62 centimeters) above openings 2. The plastic form was made of a foamed polyurethane plastic material.

As shown in FIG. 1, the pipe 1 of this invention has the openings 2 on the uppermost side to permit the entry of surface water into the pipe 1 with the rest of the pipe free of perforations. In some cases where the open top pipe drain of this invention will be used in locations having a high ground water table, it will be useful and desirable to also have perforations in the lower sides and bottom of the pipe 1 to permit the inflow of the ground water and to prevent any tendency of the pipe 1 to float out of the ground.

We claim:

1. A cylindrical culvert having a plurality of longitudinally spaced apart openings for the entry of water on the upper side of said culvert, a support member extending upwardly from each end of said openings and a serpentine bar member spaced vertically above said openings in a horizontal plane and secured to the upper ends of said support members.

2. The culvert of claim 1 in which the serpentine bar member is imbedded in concrete.

3. The culvert of claim 1 in which said bar member is supported by and secured to support members formed with material removed in forming said openings.

4. The culvert of claim 1 in which a block of plastic substantially the width of said openings extends from said openings upwardly to encase a portion of said bar member.

* * * * *

UNITED STATES PATENT AND TRADEMARK OFFICE

CERTIFICATE OF CORRECTION

PATENT NO. : 4,322,179

DATED : March 30, 1982

INVENTOR(S) : Larry N. Lamphier et al

It is certified that error appears in the above-identified patent and that said Letters Patent is hereby corrected as shown below:

On the title page, assignee should read

-- (73) Assignee: Lane Metal Products Co., Inc. --

Signed and Sealed this

*Twenty-third* Day of *November 1982*

[SEAL]

*Attest:*

GERALD J. MOSSINGHOFF

*Attesting Officer*

*Commissioner of Patents and Trademarks*